US007059011B2

(12) United States Patent
Capitani

(10) Patent No.: US 7,059,011 B2
(45) Date of Patent: Jun. 13, 2006

(54) STEAM BROOM WITH SUCTION

(75) Inventor: Emilio Capitani, Uggiate Trevano (IT)

(73) Assignee: Matic di Capitani Emilio, Como (IT)

( * ) Notice: Subject to any disclaimer, the term of this patent is extended or adjusted under 35 U.S.C. 154(b) by 353 days.

(21) Appl. No.: 10/386,725

(22) Filed: Mar. 12, 2003

(65) Prior Publication Data

US 2003/0172489 A1 Sep. 18, 2003

(30) Foreign Application Priority Data

Mar. 15, 2002 (IT) ..... BS20020037 U

(51) Int. Cl.
*A47L 5/00* (2006.01)
*A47L 11/30* (2006.01)

(52) U.S. Cl. ..... 15/320; 15/328

(58) Field of Classification Search ..... 15/320, 15/321, 350–353, 410, 328; 392/394–406
See application file for complete search history.

(56) References Cited

U.S. PATENT DOCUMENTS

| | | | | |
|---|---|---|---|---|
| 1,803,693 | A * | 5/1931 | Cutting | 15/320 |
| 4,896,396 | A * | 1/1990 | Giannelli | 15/321 |
| 5,386,612 | A * | 2/1995 | Sham | 15/320 |
| 5,502,872 | A * | 4/1996 | Chae et al. | 15/320 |
| 5,613,271 | A * | 3/1997 | Thomas | 15/321 |
| 5,819,364 | A * | 10/1998 | Sham | 15/320 |
| 6,148,144 | A * | 11/2000 | Milanese | 392/405 |
| 6,502,275 | B1 * | 1/2003 | Hsieh | 15/320 |
| 6,571,421 | B1 * | 6/2003 | Sham et al. | 15/320 |
| 6,839,933 | B1 * | 1/2005 | Wheeler et al. | 15/320 |
| 2002/0096201 | A1 * | 7/2002 | Shaw | 134/37 |
| 2003/0106180 | A1 * | 6/2003 | Tsen | 15/321 |

FOREIGN PATENT DOCUMENTS

| | | | |
|---|---|---|---|
| EP | 1027855 | * | 8/2000 |
| JP | 10-43099 | * | 2/1998 |
| JP | 11-239558 | * | 9/1999 |

* cited by examiner

*Primary Examiner*—Terrence R. Till
(74) *Attorney, Agent, or Firm*—Pearne & Gordon LLP

(57) ABSTRACT

The present invention relates to a steam broom with suction, comprising a steam production unit (14), sucking means and a water filtering unit (16), wherein said steam production unit, sucking means and filtering unit are enclosed into a base body (11), resting on rollers and wherein a handle (13) extends in height from said base body for handling, to which the motor (17) is attached.

8 Claims, 2 Drawing Sheets

STEAM BROOM WITH SUCTION

BACKGROUND OF THE INVENTION

1. Field of the Invention

The present invention relates to appliances for cleaning floors, carpets, etc., by a jet of steam and with suction of dust and liquids by water filtering.

2. Description of Related Art

These appliances generally comprise a motor for sucking the dusts and/or the liquids, a tank containing filtering water for the collection of dirt, and a steam production unit. In all of the known embodiments, these devices are enclosed in a body supported by three or four wheels with a hose extending therefrom, ending with a handle to which the accessories for steam washing or sucking are attached. The user must therefore pull such body by the handle to move it along the entire area to be cleaned, which is quite uncomfortable due to the considerable weight of the appliance and to the difficulty of guiding the sliding body around obstacles, such as furniture or walls. In fact, these appliances are called of the "pulling" type. On the other hand, object of the present finding is that of providing and proposing a steam broom with suction having the same functional elements as the appliances mentioned above but with such structure as to allow a more comfortable, easier and less tiring use.

BRIEF SUMMARY OF THE INVENTION

The object is achieved by a steam broom with suction comprising a steam production unit, means for sucking dusts and/or liquids, a motor connected to said sucking means, and a water filtering unit, where said steam production unit, sucking means and filtering unit are enclosed in a base body resting on rollers and, on its bottom side facing the floor, provided with nozzles for delivering the steam, and with an intake, and where a handle to which said motor is attached extends in height from said base body for its handling.

BRIEF DESCRIPTION OF THE DRAWINGS

An example of practical embodiment of the finding is described ore in detail hereinafter with reference to the attached indicative and non-limiting drawings, wherein.

DETAILED DESCRIPTION OF THE INVENTION

Figure 1:
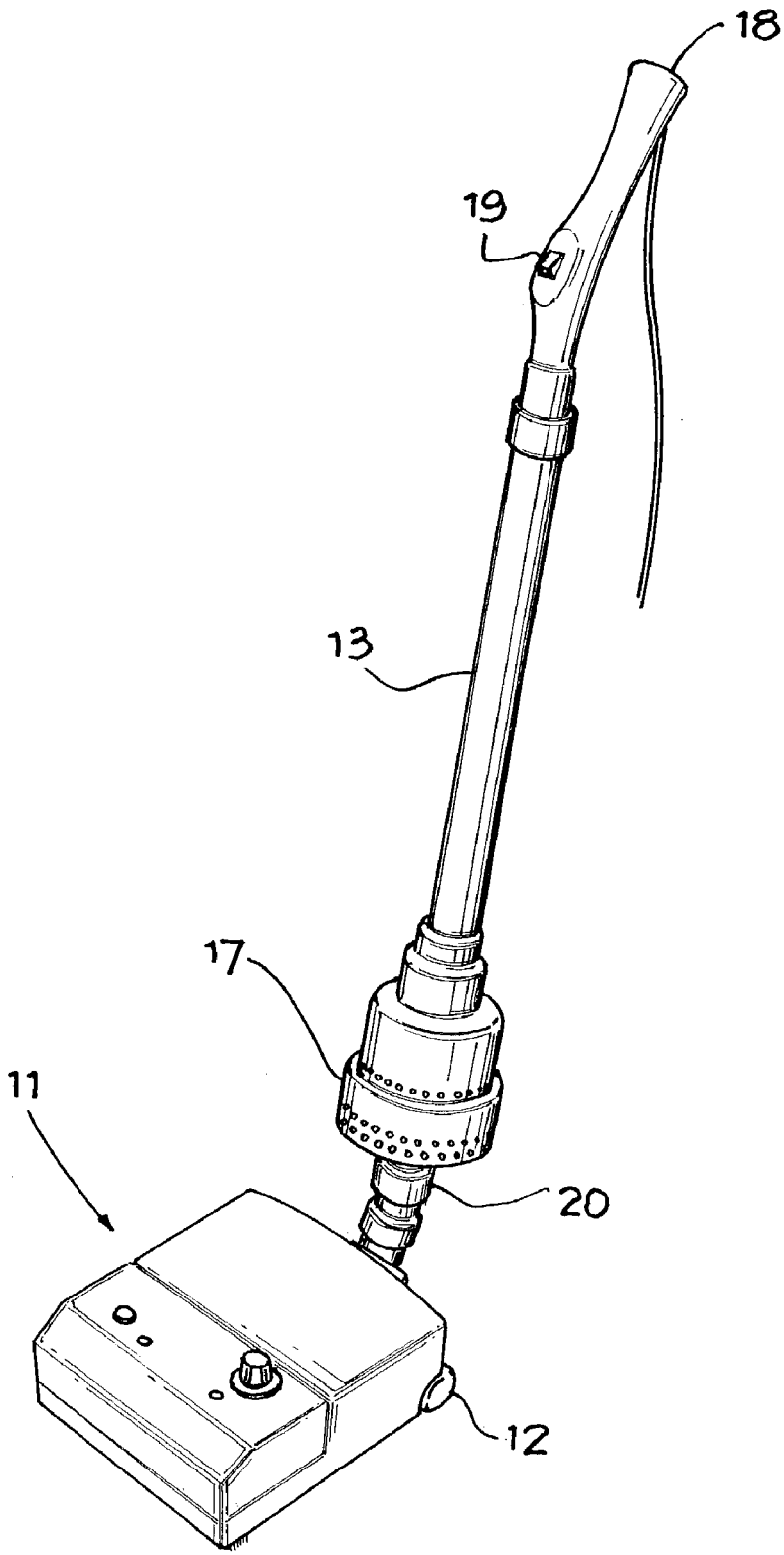
FIG. 1 globally shows an example of steam broom with suction according to the finding, in a perspective view.
Figures 2, 3:
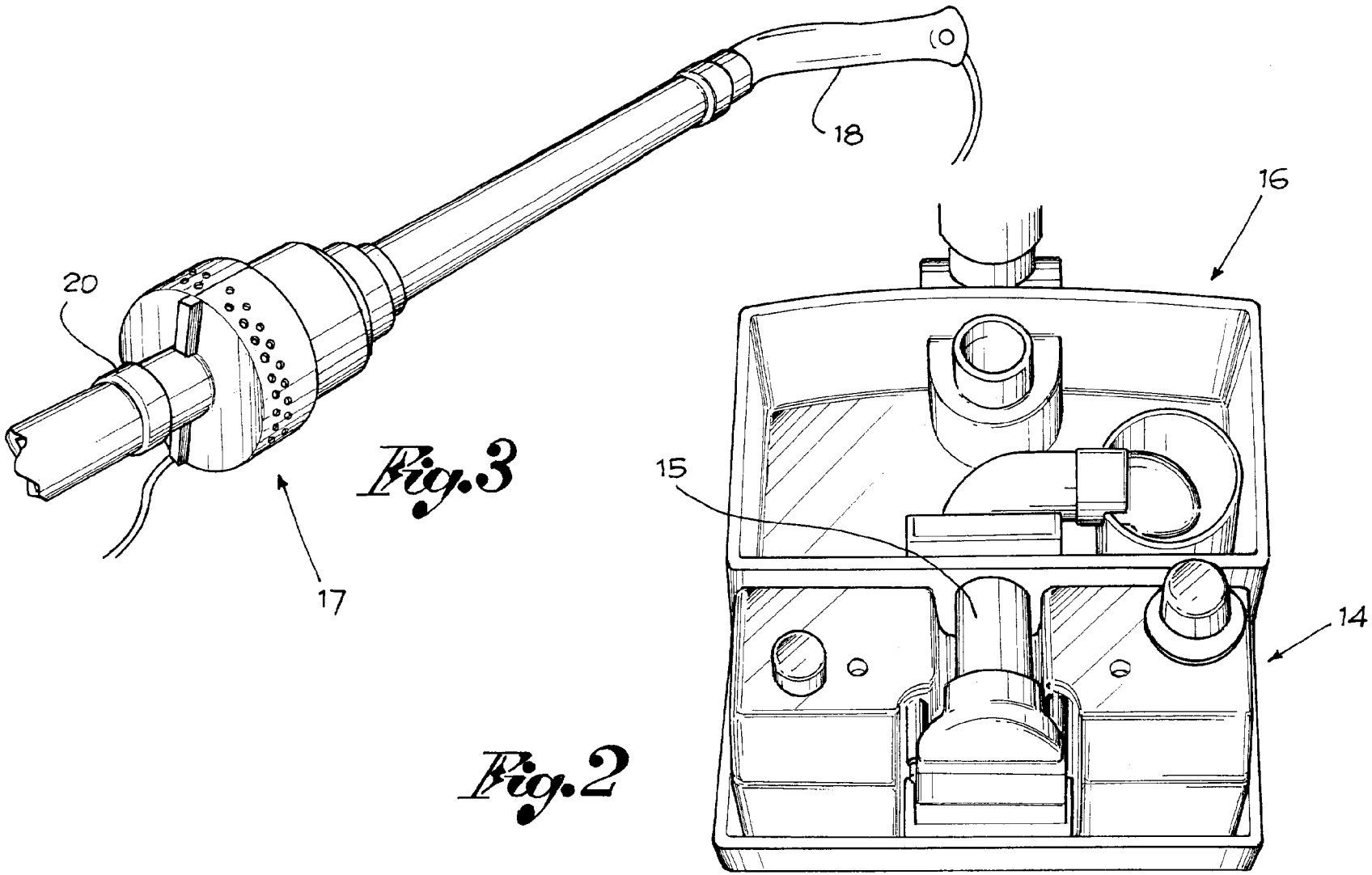
FIG. 2 shows a perspective top view of the base only, without cover, of the broom.
FIG. 3 shown the broom handle only.

The appliance under discussion exhibits a base body 11 resting onto the floor by rollers 12 and with a handle 13 that extends vertically from a side of said base body. The latter encloses a steam production unit 14, which substantially consists of a boiler, a duct 15 open towards the floor for sucking dusts and/or liquids, and a water filtering unit 16 into which said duct 15 flows. The steam production unit, which can work continuously or controlled by a solenoid valve, is intended to emit a steam jet on the floor through a plurality of nozzles, not shown.

The motor 17 for the appliance suction operation is attached to handle 13, in the proximity of, and exteriorly of, the base body 11. On top of the handle there is provided a grip 18 with buttons 19 for actuating and selecting the appliance operating mode.

Moreover, the handle can be disconnected from the base body 11 since it is provided with a union sleeve 20 located below motor 17. Once disconnected from the base body, said union sleeve 20 can be applied to a suitable filter with an optional suction accessory for allowing the use of the handle as a usual electric broom.

Moreover, it is evident that without departing from the scope of the finding, instead of the steam production unit 14 it is possible to provide for a water tank with relevant pump for delivering vaporised water.

With the above structure, the steam broom with suction is easier to handle, since it allows pulling the body containing the functional devices of the appliance, rather than drawing it, thereby guiding it more easily and with less effort.

The invention claimed is:

1. Steam broom with suction, comprising a steam production unit (14), means for sucking dusts and/or liquids (15), a motor (17) connected to said sucking means, and a water filtering unit (16), wherein said steam production unit, sucking means and filtering unit are enclosed into a base body (11) resting on rollers; the base body being provided on a bottom side facing the floor with nozzles for delivering the steam and with an intake; the steam broom further comprising a handle (13) extending in height from said base body for handling, said steam broom; said motor (17) being mounted on said handle (13) exteriorly of said base body.

2. Steam broom with suction according to claim 1, wherein the motor is attached to the base of said handle.

3. Steam broom with suction according to claim 2, wherein downstream of the motor, the handle comprises a union sleeve (20) for disconnecting from the base body and for applying a filter and a suction accessory so as to work as an electric broom.

4. Steam broom with suction according to claim 2, wherein on top of the handle there is provided a grip (18) with buttons (19) for actuating and selecting the broom operating mode.

5. Steam broom with suction according to claim 1, wherein downstream of the motor, the handle comprises a union sleeve (20) for disconnecting from the base body and for applying a filter and a suction accessory so as to work as an electric broom.

6. Steam broom with suction according to claim 5, wherein on top of the handle there is provided a grip (18) with buttons (19) for actuating and selecting the broom operating mode.

7. Steam broom with suction according to claim 1, wherein on top of the handle there is provided a grip (18) with buttons (19) for actuating and selecting the broom operating mode.

8. Steam broom with suction, comprising a steam production unit (14), means for sucking dusts and/or liquids (15), a motor (17) connected to said sucking means, and a water filtering unit (16), wherein said steam production unit, sucking means and filtering unit are enclosed into a base body (11) resting on rollers; the base body being provided on a bottom side facing the floor with nozzles for delivering the steam and with an intake; the steam broom further comprising a handle (13) extending in height from said base body for handling said steam broom; said motor (17) being mounted on said handle (13); wherein downstream of the motor, the handle comprises a union sleeve (20) for disconnecting from the base body and for applying a suction accessory so as to work as an electric broom.

* * * * *

UNITED STATES PATENT AND TRADEMARK OFFICE

CERTIFICATE OF CORRECTION

PATENT NO. : 7,059,011 B2
APPLICATION NO. : 10/386725
DATED : June 13, 2006
INVENTOR(S) : Emilio Capitani It is certified that error appears in the above-identified patent and that said Letters Patent is hereby corrected as shown below:

In the Specification, Column 2, line 10, please delete “pulling” and insert therefor --pushing--.

Col. 2, Line 25, after the word “handling” please delete the comma.

Signed and Sealed this

Twenty-first Day of November, 2006

JON W. DUDAS
*Director of the United States Patent and Trademark Office*